US006187717B1

(12) United States Patent
Wikborg et al.

(10) Patent No.: US 6,187,717 B1
(45) Date of Patent: Feb. 13, 2001

(54) ARRANGEMENT AND METHOD RELATING TO TUNABLE DEVICES THROUGH THE CONTROLLING OF PLASMA SURFACE WAVES

(75) Inventors: Erland Wikborg, Danderyd (SE); Orest Vendik, S. Petersburg (RU); Erik Kollberg, Lindome; Spartek Gevorgian, Göteborg, both of (SE)

(73) Assignee: Telefonaktiebolaget LM Ericsson, Stockholm (SE)

( * ) Notice: Under 35 U.S.C. 154(b), the term of this patent shall be extended for 0 days.

(21) Appl. No.: 08/985,149

(22) Filed: Dec. 4, 1997

Related U.S. Application Data

(63) Continuation of application No. PCT/SE96/00769, filed on Jun. 13, 1996.

(30) Foreign Application Priority Data

Jun. 13, 1995 (SE) ..... 9502138

(51) Int. Cl.[7] ..... H01P 7/00; H01B 12/02

(52) U.S. Cl. ..... 505/210; 505/700; 505/701; 505/866; 333/99 S; 333/219; 333/235

(58) Field of Search ..... 333/995, 219, 333/235, 239; 505/210, 700, 701, 866

(56) References Cited

U.S. PATENT DOCUMENTS

| | | | | |
|---|---|---|---|---|
| 5,136,268 | * | 8/1992 | Fiedziuszko et al. | 505/866 |
| 5,179,074 | | 1/1993 | Fiedziuszko et al. | 505/210 |
| 5,208,213 | * | 5/1993 | Ruby | 505/210 |
| 5,285,067 | | 2/1994 | Culbertson et al. | 505/866 X |

FOREIGN PATENT DOCUMENTS

| | | |
|---|---|---|
| 0 496 512 | 1/1992 | (EP) . |
| 94/13028 | 12/1993 | (WO) . |
| 94/28592 | 5/1994 | (WO) . |
| 96/42118 | 12/1996 | (WO) . |

OTHER PUBLICATIONS

Adams, M. J., "An Introduction to Optical Waveguides", John Wiley, (1981).
Bhartia, P. et al., "Millimeter Wave Engineering and Application", J. Wiley (1984).
Dedyk, A.I. et al., "The Dielectric Hysteresis of YBCO–$SrTio_3$_YBCO Structures at 4.5K", Ferroelectircs, vol. 144, pp. 77–81, (1983).
Galt, D. et al., "Characterization of . . . Coplanar Capacitor", Appl. Phys. Lett., vol., 63, No. 22, Nov. 1963.
Krupka, Jerry et al., "Dielectirc Properties of Single Crystals of . . . Cryogenic Temperatures", IEEE Microwave Theory Technology, vol. 42, No. 10, pp. 1886 (1984).
Mei, K.K., "Electromagnetics of Superconductors", IEEE Trans Microwave Theory Techn. vol. 39, No. 9, 1991.
Shen Z.Y., "High–Temperature Superconducting Microwave Circuits", Artech House, (1994).
Vendik, O.G., et al., "1 GHZ tunable . . . YBa2Cu307 films", Electronic Letters, vol. 31, No. 8, pp. 654–656 Apr. 1995.

* cited by examiner

*Primary Examiner*—Benny T. Lee
(74) *Attorney, Agent, or Firm*—Burns, Doane, Swecker & Mathis, L.L.P.

(57) ABSTRACT

A tunable microwave monolithic integrated circuit includes a dielectric material with a variable dielectric constant. A superconducting material with a negative dielectric constant is provided which is arranged in relation to the dielectric material in such a way that at least one interface is formed between the superconducting material and the dielectric material. The dielectric material is a low loss non-linear bulk material. Phase velocity tuning of microwaves is provided through controlling the propagation of surface plasma waves of the microwaves along the interface(s).

30 Claims, 6 Drawing Sheets

ARRANGEMENT AND METHOD RELATING TO TUNABLE DEVICES THROUGH THE CONTROLLING OF PLASMA SURFACE WAVES

This application is a continuation of International Application No. PCT/SE96/00769, filed Jun. 13, 1996, which designates the United States.

BACKGROUND

The present invention relates to tunable microwave dielectric monolithic integrated circuits. The invention also relates to a method for tuning the phase velocity of microwaves in a microwave monolithic integrated circuit. Tunable microwave devices as such are of considerable interest for example within microwave communication, radiosystems and cellular communications systems etc.

A number of tunable microwave devices have been suggested. U.S. Pat. No. 5,285,067 for example shows a superconducting resonator on a non-ferroelectric (linear) substrate wherein input and output respectively are formed by microstrips. Via optical illumination the properties of the superconducting films are changed (tuning) which results in a shift in resonant frequency. Apart from optical illumination also other means can be used to change or control the properties of the superconducting films and thus provide controllability. However, for optical tuning a high optical power is required and the tuning is not very effective.

U.S. Pat. No. 5,179,074 illustrates dielectric resonators in super-conducting cavities having a low loss at high microwave power levels. However, the designs are bulky and involve a complicated and expensive fabrication technology and they are not suitable for monolithic microwave integrated circuits.

From WO 94/13028 a number of tunable microwave devices based on high temperature superconductors and ferroelectric thin film microstrip waveguide designs are known. However, these devices suffer from unacceptable high microwave losses and low tunability due to the low inherent quality of the ferroelectric film. Moreover the microwave power handling capability is low among other reasons due to the low quality of the ferroelectric film and the high non-linear behaviour (over-tone generation) of narrow HTS-strips.

Furthermore, image waveguides comprising a dielectric arranged on top of a metallic ground plane have been used for millimeter and submillimeter wavelength integrated circuits, see for example P. Bhartia and I. J. Bahl in "Millimeter Wave Engineering and Applications", J. Wiley, 1984 and for devices in the optical spectrum, c.f. M. J. Adams, "An Introduction to Optical Waveguides", J. Wiley, 1981. However, the implementation of this Microwave Integrated circuit (MIC) technology at frequencies below 3 GHz has been limited by dielectrics having a low dielectric constant, and low losses, $\tan\delta > 10^{-4}$, which imply large dimensions of the dielectric MIC.

Generally, dielectric materials used in microwave technology have had a dielectric constant of 0–100, which would only result in gigantic devices at the frequencies of about 1–2 GHz. In "High Temperature Superconducting Microwave Devices", by Z-Y Shen, Artech House, 1994 dielectric resonators based on $TM_{01\delta}$ delta modes are disclosed. The dielectric resonator is clamped between thin high temperature superconducting films which are deposited on separate substrates arranged between the thin film and the dielectric. Even if the surface resistance and the associating microwave losses of the high temperature superconductor materials are extremely low at 1–2 GHz, typically $10^{-4}$ Ohm, these devices suffer from not having the desirable properties in that the dimensions of the superconducting films and the dielectric substrates at these frequencies (e.g. 1–2 GHz) are large and the devices are expensive to fabricate. Moreover they can only be tuned mechanically and therefore the devices get bulky and introduce complex problems in connection with vibrations or microphonics.

SUMMARY

Therefore tunable microwave devices are needed through which microwave monolithic integrated circuits can easily and inexpensively be fabricated and through which the size can be further reduced. Particularly fully integrated devices as circuits are needed for e.g. compact devices. Particularly microwave monolithic integrated circuits are needed which can be fabricated in a single processing chain with standard integrated circuits technology and with precise sizes and dimensions. Moreover microwave integrated circuits are needed having a good performance. Particularly devices are needed which do not require complicated assembling processes at all. Still further microwave integrated circuits are needed which have a high electrical performance. Particularly microwave monolithic integrated circuits are needed for use in the frequency band of about 1–2 GHz. In the copending patent application "Tunable microwave devices" by the same applicant filed at the same day published as WO 961 42118 and which is incorporated herein by reference, tunable microwave devices are described.

Therefore a tunable microwave monolithic integrated circuit is provided which comprises a dielectric material and a superconducting arrangement which is so arranged in relation to the dielectric material that at least one interface is formed between the superconducting material and the dielectric material which is a low loss non-linear bulk material and wherein the dielectric and/or the superconducting material has/have a variable dielectric constant. Frequency tuning is obtained by controlling the propagation of surface plasma waves of the microwave signals along the interface or the interfaces. The superconducting arrangement particularly comprises a high temperature superconducting material such as e.g. YBCO; for example $YBa_2Cu_3O_7$, $TlBa_2CaCu_2O_7$, $Ba(Bi,Pb)O_3$. Further examples on HTS materials are given by Z-Y Shen in "High Temperature Superconducting Microwave Devices". The dielectric material may e.g. be $SrTiO_3$ or anything having similar properties. In an article by Krupka et al, IEEE Microwave Theory Techn., 1994, Vol 42, No 10, p. 1886, it was stated that dielectric materials with non-linear properties, such as e.g. $SrTiO_3$, have an extremely high dielectric constant, $\epsilon$=3000–25000, at temperatures of liquid nitrogen (77° K) and below that: Further examples are e.g. solid solutions of Strontium and Barium Titanates. Particularly the arrangement comprises a waveguide arrangement.

Generally it can be said that the strongly negative dielectric constant of the high temperature superconducting material is a precondition for the existence of surface plasma waves. The fact that high temperature superconducting materials have a strongly negative dielectric constant was first recognized in a publication by K. K. Mei and G. Liang in "Electromagnetics of superconductors" IEEE Trans. Microwave Theory Techn. 1991 Vol 39, No 9. Tuning means are provided for controlling the propagation of the surface plasma waves or the surface plasmons. In a particular embodiment the microwave integrated circuit/circuits comprises a dielectric ridge waveguide and particularly a superconducting film may be arranged on one side of the slab of dielectric material opposite the side on which a ridge is formed thus forming an image ridge waveguide. The superconducting film, particularly the high temperature superconducting film in the waveguide may act as a channel for electromagnetic waves having a frequency of approximately 1–2 GHz. Of course it may be appropriate for other frequencies. Generally, also other strip waveguides could be used such as raised strip and strip loaded waveguides.

In a particularly advantageous embodiment of the invention the dimensions of the waveguide are such that it only supports propagation of the fundamental transverse magnetic mode $TM_o$ of the electromagnetic wave whereas all transverse electric modes TE are prevented from propagation. By controlling the surfaces plasma waves, i.e. the supported modes, that propagate along the interface or the interfaces, the phase velocity of the waves can be tuned.

In another embodiment of the invention a first superconducting film is arranged on one side of the dielectric material which is provided with a ridge or a rib forming as stripguide and a second superconducting film is arranged on the dielectric ridge thus forming a parallel plate waveguide. The dimensions of the parallel plate waveguide are chosen so as to only support the propagation of two fundamental modes of the surface plasma waves, namely $TM_o$, $TM_1$, along the interfaces between the dielectric material and the respective superconducting film.

Another embodiment of the invention relates to a parallel plate resonator with input and output couplings. The parallel plate resonator may be rectangular or circular, but it may also take any other form. Such resonators are also described in the copending patent application filed on the same day, by the same applicants named "Tunable microwave devices". The input and output couplings may each be formed by an image ridge waveguide or by a parallel waveguide. Gaps are provided between the input/output image ridge waveguides (or parallel plate waveguides) and the parallel plate resonator for controlling the coupling between them. The parallel plate resonator may be a dual mode resonator (multimode resonator) and means can be arranged to provide coupling between degenerate modes of microwaves inside the resonator. These coupling means may be arranged in different ways as also described in the copending patent application referred to above. One example of coupling means may be a protruding portion of the superconducting film arranged on one side of the dielectric resonator but it may also comprise a recess or a cut-out portion, a notch or something similar in the superconducting film arranged on the dielectric material of the parallel plate resonator.

Also the devices referred to above may be provided with a non-superconducting metal film arranged on the superconducting film, i.e. on the external portions of the superconducting film; not between the superconducting film and the dielectric material.

The tuning can be provided for in different ways, e.g. via optical tuning such as irradiation with light or it can be temperature controlled in which case means are provided for changing the temperature at the interfaces etc. The parallel plate resonator can also be tuned electrically by application of a DC bias voltage to the superconducting films in order to change the dielectric constant of the dielectric material.

Generally, when optical means are used it is the change in negative dielectric constant of the superconducting material that enables the tuning of the surface plasma modes whereas when means for changing the temperature at the interface are used it is the change in the dielectric constant of the dielectric material or the change in the dielectric constant of high temperature superconducting material that is used, but it can also be a combination of both in the latter case. When a DC biasing voltage is applied, the change in dielectric constant of the dielectric material enables the tuning of the phase velocity of the surface plasma waves. The tuning means (optical/temperature/DC biasing) may also be used in any combination as for as they are applicable, i.e. for image ridge waveguides only optical/temperature tuning is possible.

Furthermore methods are provided for tuning the phase velocity of microwaves in a microwave integrated circuit which comprises at least one superconducting film arranged on a non-linear bulk dielectric material wherein the propagation of surface plasma waves along the interfaces formed between the dielectric material and the superconducting film(s) is controlled.

BRIEF DESCRIPTION OF THE DRAWINGS

The invention will in the following be further described in a non-limiting way under reference to the accompanying drawings in which like reference numbers/labels appearing in different figures refer to like elements/features that may not be illustrated in detail for all figures in which they appear and.

DETAILED DESCRIPTION

Figure 1A:
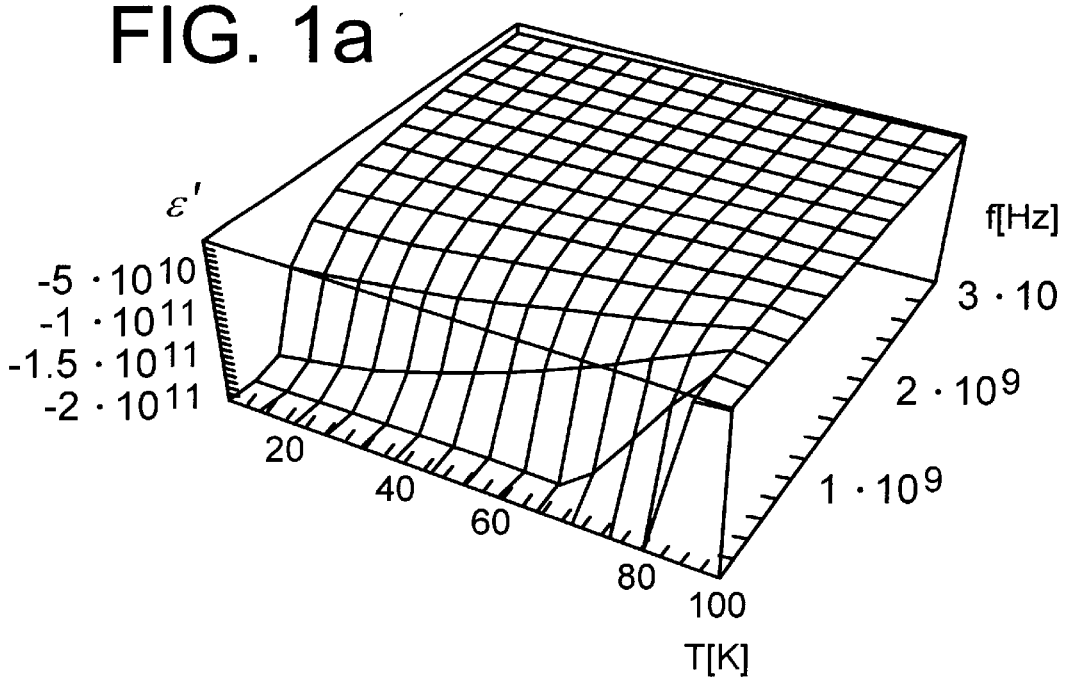
FIG. 1*a* illustrates the real part of the dielectric constant of YBCO.
Figure 1B:
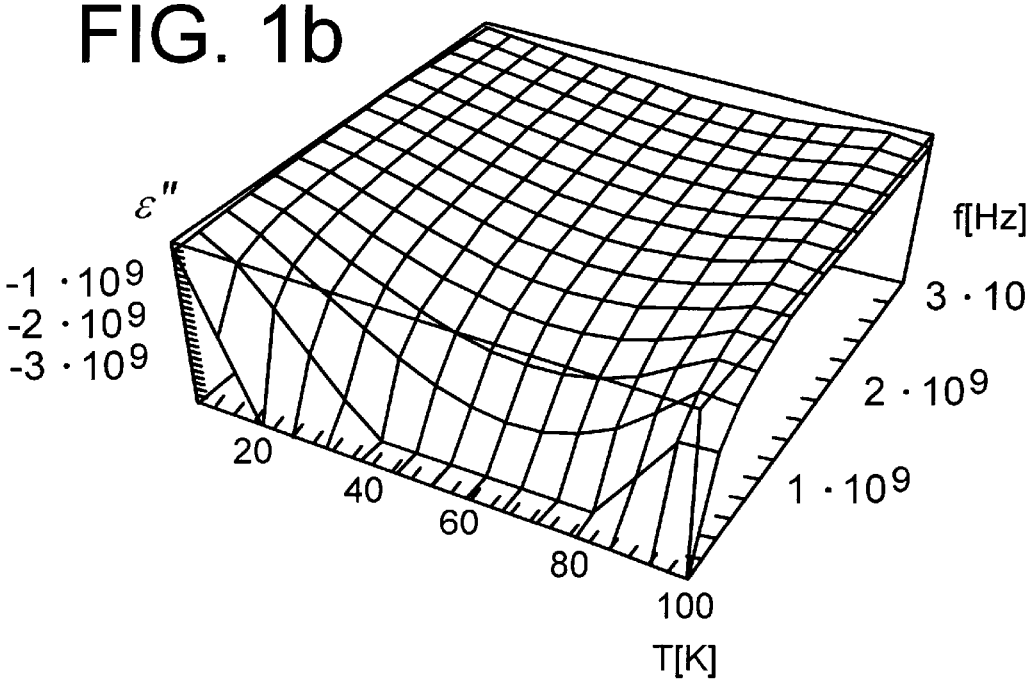
FIG. 1*b* illustrates the imaginary part of the dielectric constant of YBCO.
Figure 2A:
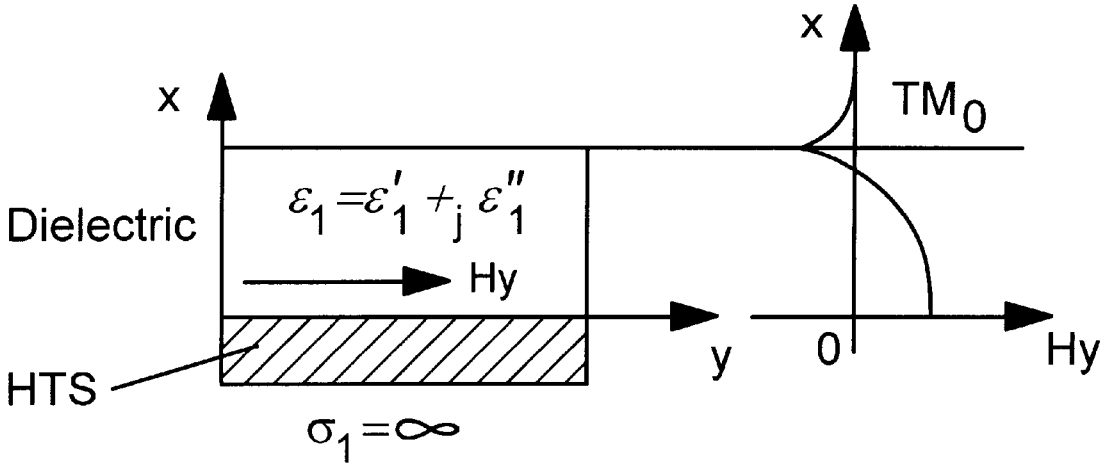
FIG. 2*a* illustrates the magnetic field distribution in an image waveguide having a normal metal ground plane.
Figure 2B:
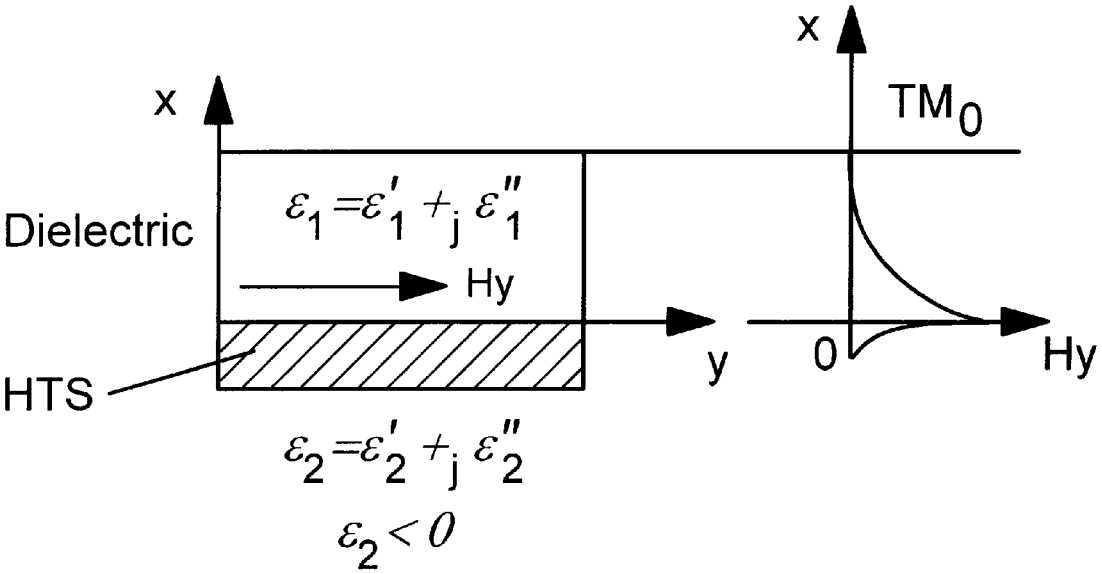
FIG. 2*b* illustrates the magnetic field distribution of an image waveguide having a superconductor as ground plane.
Figure 3A:
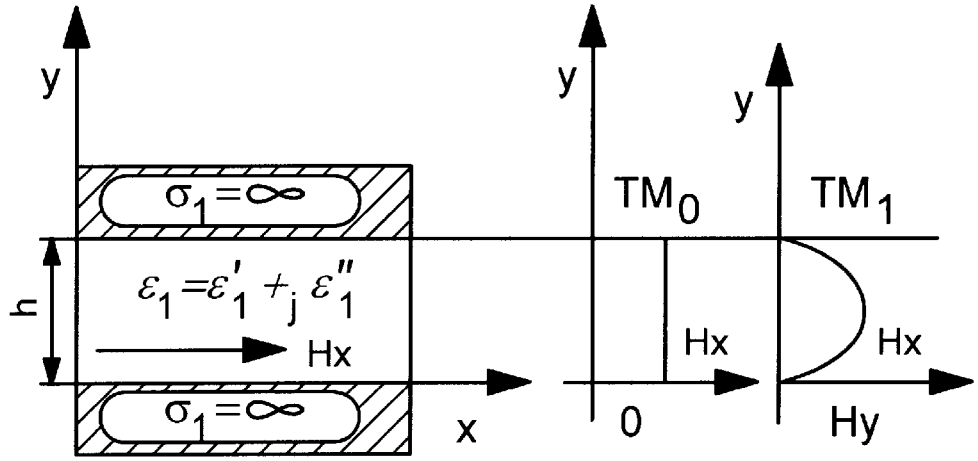
FIG. 3*a* illustrates the magnetic field distribution in a parallel plate waveguide with conducting planes of a perfect metal or a normal metal.
Figure 3B:
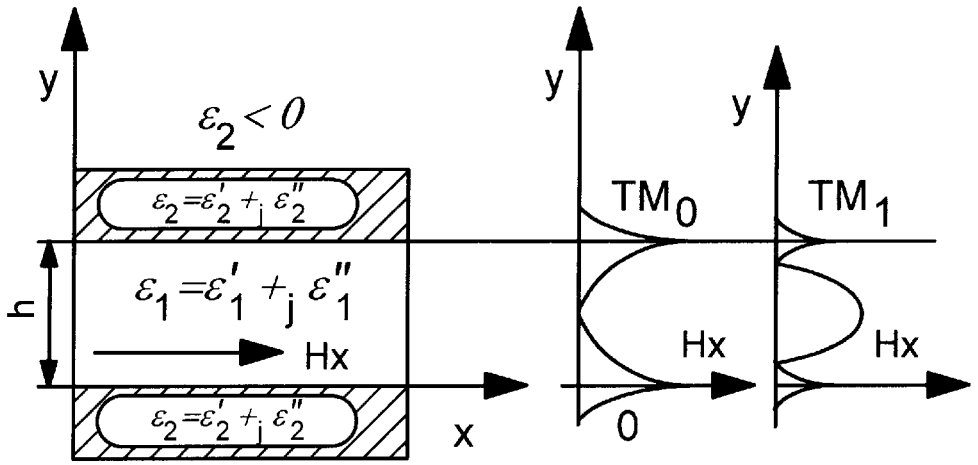
FIG. 3*b* illustrates the magnetic field distribution in a parallel plate waveguide comprising superconducting planes.

The dielectric constant $\in$ of a material can be divided into a real part $\in'$ and an imaginary part $\in''$. FIG. 1*a* illustrates the variation in the real part $\in$ of the dielectric constant of a high temperature superconducting material YBCO with temperature T and frequency f. FIG. 1*b* illustrates in a similar way the imaginary part $\in''$ of a high temperature in superconducting material YBCO varying with temperature T and frequency f. As can be seen from the figure, the dielectric constant of the high temperature superconducting material is negative. The dielectric materials to be used in the present invention on the other hand have an extremely high positive dielectric constant. The surface plasma wave (the surface plasmon) propagation along the interface of the dielectric material and a superconducting material, particularly high temperature superconducting material, is used for tuning. Surface plasmons are for example discussed in M. J. Adams, "An Introduction to Optical Waveguides", John Wiley, 1981. The fact that the dielectric constant of high temperature superconducting materials is negative and has a high absolute value is important, since if it were not negative, there would be no surface plasma waves. FIGS. 2*a* and 2*b* are merely intended to show a comparison between the magnetic field distribution in an image waveguide if the ground plane is a normal metal and a superconductor respectively. This example is given for illustrative purposes and the use of a high dielectric constant non-linear dielectric such as for example $SrTiO_3$ with a normal metal such as Au, Ag, Cu to form an image waveguide (or a parallel plate waveguide) for tunable dielectric microwave integrated circuits for example for frequency band of 1–2 GHz and the temperature of 77 K (corresponding for example to a superconducting state of high temperature superconductor) in practice can only find a very limited use. This is so because the losses in the normal metals are very high and furthermore the tuning efficiency is very low because of the migration of charged carriers from the metal to the dielectric material. This is also discussed in Dedyk A. I. Plotkina N. W., and Ter-Martirosyan L. T. "The Dielectric Hysteresis of YBCO-$SrTiO_3$-YBCO structures at 4.2K" Ferroelectrics, 1993, Vol. 144 pp. 77–81. In the case of high temperature superconductors with a work function higher than that of the dielectric (e.g. $SrTiO_3$), there is no charge migration across the superconductor/dielectric interface and the tuning efficiency of the dielectric constant of the non-linear dielectric is high. Additionally, the extremely large negative dielectric constant of the high temperature superconductor is a precondition for the propagation of surface plasma waves along the dielectric/superconductor interface (interfaces). From FIGS. 2*a*, 2*b* it can be seen that for a guide with a dielectric having a dielectric constant $\in$ in contrast to a uniform magnetic field distribution Hy in the normal metal image guide having an infinite loss $\sigma_1$, FIG. 2*a*, the magnetic field distribution Hy in the superconducting image guide HTS having a negative dielectric constant $\in_2$ with surface plasma waves is nonuniform. From FIG. 2*b* it can be seen that the magnetic field Hy has a maximum at the interface between the superconductor and the dielectric and decays slowly in the dielectric. Thus the field can be said to be concentrated at the interface which implies that any change in the dielectric constant of the high temperature superconducting material will result in a maximum change in phase velocity of the surface plasma waves. Thus controlling of the phase velocity of the surface plasma waves is very efficient. For similar reasons FIGS. 3*a* and 3*b* respectively illustrate the differences between the magnetic field distribution Hy in a parallel plate waveguide with a dielectric having a constant $\in_1$ when e.g. normal metal conducting planes having an infinite loss $\sigma$ are used and when superconducting planes having a negative dialectic constant $\in_3$ are used. The difference in relation to FIGS. 2*a* and 2*b* can in a simplified manner thus be said to be that in FIGS. 3*a* and 3*b* there are two interfaces instead of one.

Figure 4:
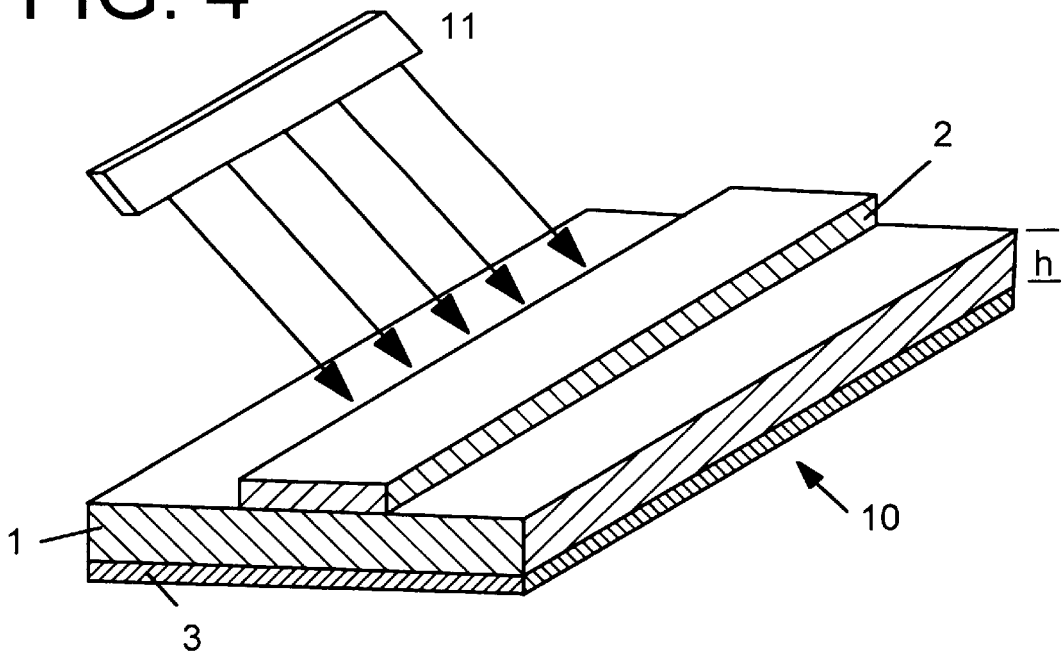
FIG. 4 illustrates an image ridge waveguide.

FIG. 4 illustrates a first embodiment of the invention comprising a low-loss, small size image ridge (rib) waveguide 10. A single crystalline bulk non-linear dielectric 1 is provided with a ridge 2 at the upper surface. The ridge 2. e.g. can be formed by means of photolithography or by any other relevant technique which is known per se. A first superconducting film 3 is arranged on the dielectric material 1 thus forming a superconducting ground plane. The image ridge waveguide 10 can be said to act as a channel for electromagnetic waves in a frequency band of approximately 1–2 GHz. The dimensions of the image ridge waveguide 10 are chosen in such a way that all TE-type waves are cut off whereas only the fundamental TM-mode is supported. This TM-mode is a surface plasma wave (surface plasmon) which propagates along the interface of the superconducting film 3, particularly a high temperature superconducting film such as e.g. YBCO and the non-linear dielectric 1, e.g. $SrTiO_3$. The dimensions are so chosen that the thickness h of the ridge waveguide is smaller than half the wavelength in the dielectric $\lambda_g$.

Generally $$\lambda_g = \frac{\lambda_0}{\sqrt{\varepsilon_{diel}}}$$

wherein a$\lambda_o$ refers to the wavelength in free space and $\in_{diel}$ refers to the dielectric constant to a material. To give a simplified example thereon, the dielectric constant of $SrTiO_3$ is approximately 2000 at 77° k.

If the frequency fo is supposed to be approximately 1 GHz, $\lambda_o$ is about 30 cm. Then $\lambda$g will be 30/(2000). i.e. approximately 0.75 cm. The thickness should be smaller than 0.75 cm/2, i.e. 3.75 mm. According to an advantageous embodiment the thickness h is about 0.5 mm for only supporting the $TM_o$ mode.

The phase velocity of the waves can be tuned by irradiation of the image ridge waveguide 10 with light from an optical source 11. The optical means 11 are so arranged that the interface dielectric material/superconductor is irradiated. Since the dielectric material is transparent, the means can be arranged substantially at any location (here e.g. above) from which the dielectric is exposed to the irradiation. Alternatively the temperature can be changed (not illustrated in the figure). The temperature changes can be achieved in any convenient manner known per se.

Tuning of the phase velocity of the surface plasma waves is achieved by changing the negative dielectric constant of the superconducting material via optical illumination and/or changing the temperature at the interface superconductor-dielectric of the image waveguide 10. If particularly a high temperature superconductor is used, which has a very high work function as compared to the dielectric, there will arise no problems of migration of charge carriers into the dielectric material. This contributes in making the performance of the tuning very high.

Figure 5:
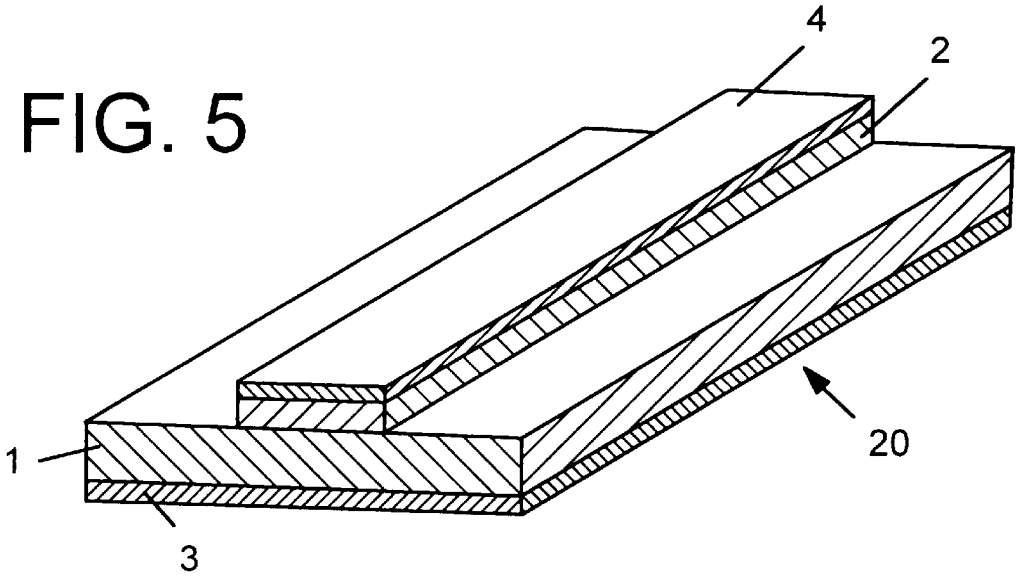
FIG. 5 illustrates a parallel plate waveguide.

In FIG. 5 a parallel plate waveguide 20 is illustrated. On the surface of a bulk non-linear dielectric material a ridge 2 is provided. A first superconducting film 3 is arranged forming a first plane on a dielectric material 1 and a second superconducting film 4 is arranged on top of the dielectric ridge 2 forming a second plane of the parallel plate waveguide 20. The parallel plate waveguide 20 supports two fundamental surface plasma waves $TM_o$ and $TM_1$ which propagate along the interfaces between the dielectric material 1, 2 and the respective superconducting film 3, 4. Tuning can for example be provided via optical illumination, and/or by changing the temperature of the device as described above in the relation to the image ridge waveguide 10. Moreover, electrical tuning can be used by which the dielectric constant of the dielectric material can be changed or tuned and so the phase velocity of the plasma waves can be tuned. This will also be further described under reference to FIG. 6.

Optical tuning produces a change in dielectric constant of the superconducting material whereas using the temperature for tuning produces a change of the dielectric constant of the superconductor and/or of the dielectric. Via electrical tuning, a change in the dielectric constant of the dielectric material is produced. Those tuning methods can be used separately or in any combination.

Figure 6:
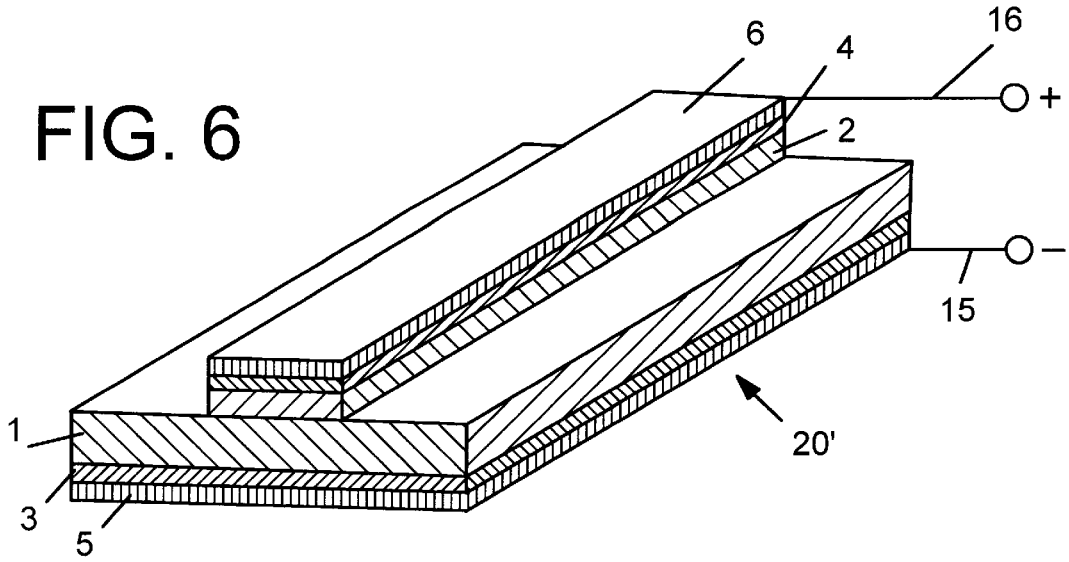
FIG. 6 illustrates an electrically controllable parallel plate waveguide.

In FIG. 6, which illustrates a parallel plate waveguide 20' which is similar to the parallel plate waveguide 20 of FIG. 5 with the modification that a first normal non-superconducting film 5 and a second normal non-superconducting film 6 are arranged on the superconducting films 3, 4. As in FIG. 5, the film 3 is disposed on a dielectric material 1. The normal conductor films 5, 6 may serve the purpose of protecting the superconducting films 3, 4. Moreover they may serve as contacts for DC biasing which is illustrated in this figure. Two leads, a negative lead (–) 15, and a positive lead (+) 16 are arranged for connecting e.g. to a voltage source for DC biasing of the waveguide. The protecting films 5, 6 may also assist in providing a high quality factor (Q-factor) also above the critical temperature $T_c$ (the critical temperature means the temperature below which the material is superconducting) but also for providing a long term chemical protection of the superconducting film.

Figure 7:
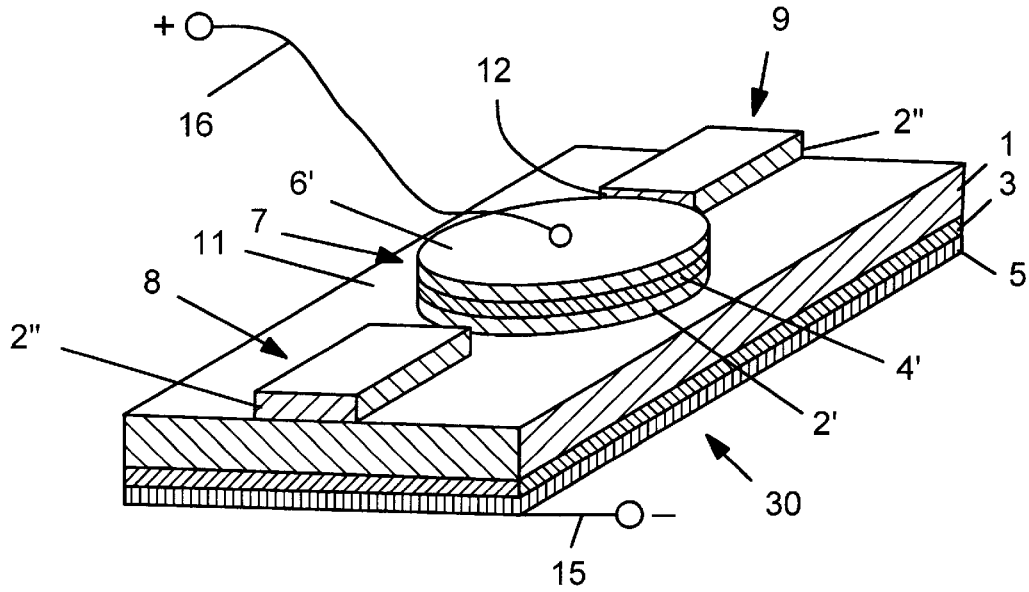
FIG. 7 illustrates a dielectric integrated circuit parallel plate resonator with input/output coupling ridge waveguides.

In FIG. 7 an integrated parallel plate resonator 30 with input and output image waveguides is illustrated. On a dielectric substrate 1 on which a superconducting film 3 is arranged, a dielectric material 2' in the form of a circular plate is arranged on that side of the dielectric material 1 which is opposite to the superconducting film 3. The dielectric circular plate 2' is covered by a second superconducting film 4' of substantially the same shape to form a circular parallel plate resonator. Of course it could also have been a rectangular parallel plate resonator; further still it could have any of appropriate form. The superconducting films 3, 4' are each covered by a normal metal, non-superconducting film 5, 6' for protection and also serving as ohmic contacts etc. as discussed above. The circular dielectric plate 4' forms a dielectric mesa structure which can be photolithographically etched from the bulk dielectric 1 but it could also be formed by any other convenient as technique known per se. Image waveguides 8, 9 comprising dielectric ridges 2", form input and output waveguides respectively to the parallel plate resonator 7. Coupling gaps 11, 12 are provided between the input and output image waveguides respectively and the parallel plate resonator 7 for coupling microwaves signals in and out of the parallel plate resonator 7. As in FIG. 6, a negative (–) lead 15 and a positive (+) lead 16 are arranged for connecting e.g. to a voltage source.

Figure 8:
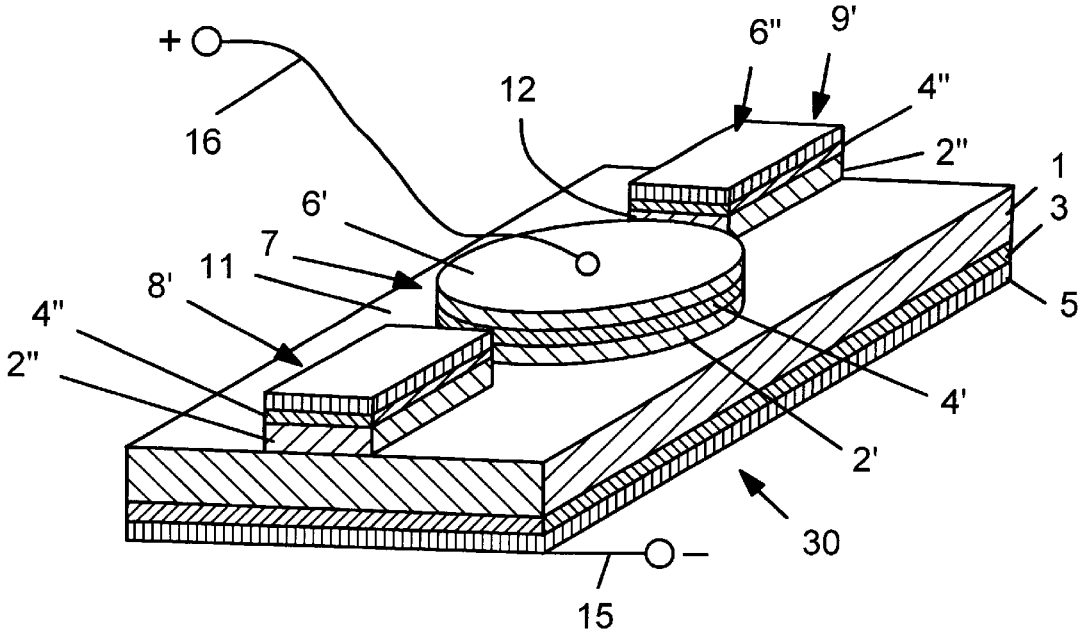
FIG. 8 illustrates a dielectric integrated circuit parallel plate resonator with input/output parallel plate waveguides and FIG. 9 illustrates a dual mode parallel plate tunable resonator.

In the arrangement 30' of FIG. 8 input/output waveguides 8', 9' also comprise a dielectric material 2" on which a superconducting film 4" is arranged thus forming input/output parallel plate waveguides, and on which films for example protective non-superconducting films 6" can be arranged. Application of an external D.C. field to input/output parallel plate waveguides (not shown in FIG. 8) gives a high flexibility as far as coupling problems are concerned and is thus advantageous. Leads 15, 16 are arranged as described above in relation to the embodiment illustrated in FIG. 6 to enable electrical tuning of the device, i.e. for applying a DC biasing voltage.

Of course, alternatively this device can, instead of being electrically tuned, be optically tuned and/or temperature controlled/tuned. As in FIG. 7, the arrangement 30' includes substrate 1 on which are arranged dielectric material 2', films 3, 4', 5, 6', and resonator 7, coupling gaps 11, 12, and a negative (–) lead 15 and a positive (+) lead 16 for connecting e.g. to a voltage source.

Figure 9:
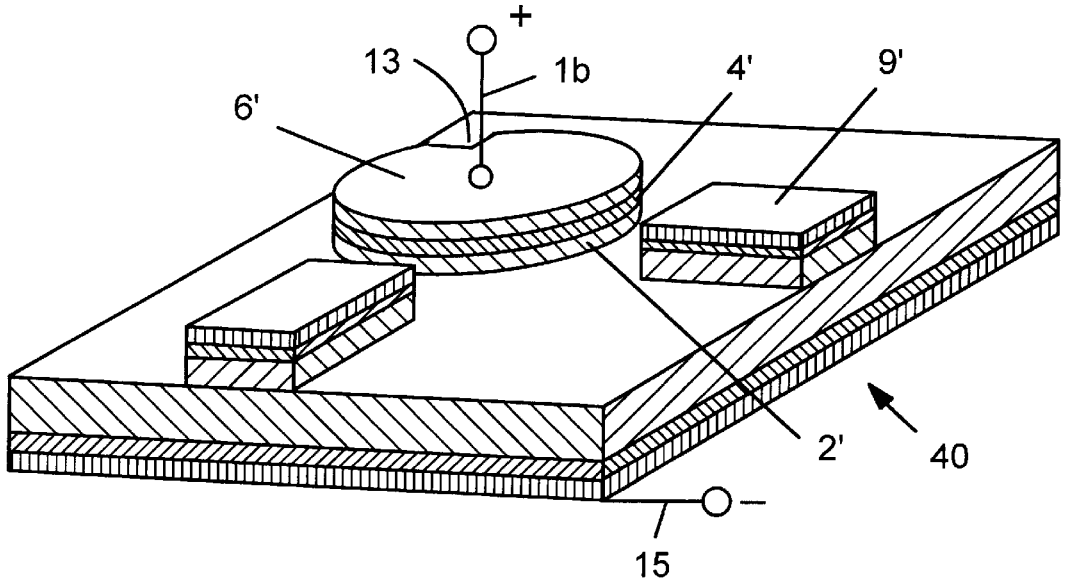

In FIG. 9 a microwave integrated circuit in the form of a tunable two-pole filter 40 is illustrated. The reference numerals are the same as in FIG. 7 (and 8), the difference being that means 13 are provided in order to enable coupling between degenerate modes of the parallel plate resonator 7. The coupling means comprise a cut-out portion of the superconducting film 4'. The corresponding cut-out has also been done in the protective film 6'. However, the coupling between degenerate modes may also be provided via a protruding portion or a notch of the superconducting film in relation to the dielectric material 2'. Coupling may also be achieved in many other ways. The coupling between degenerate modes of the two-pole filter, or a multi-mode filter, is also discussed in the copending patent application "Tunable microwave devices" as referred to above. Also in this embodiment electrical tuning is illustrated but it is also in this case possible to instead of electrical tuning apply optical tuning and/or temperature tuning or any combination of tuning. In addition to a two-pole passband filter, a multiple passband filter can be provided in a similar way. The invention is not limited to the illustrated microwave integrated circuits; a few examples have merely been chosen for illustrative purposes. E.g. an alternative relates to four-pole filters etc.

By using high quality bulk single crystal dielectric materials such as e.g. $SrTiO_3$ with a high dielectric constant and very low dielectric losses together with high temperature superconducting films is it possible to achieve substantial reductions relating to losses as well as considerable size reductions of the microwave integrated circuits. Particularly it is possible to make monolithic dielectric integrated circuits for the frequency band of about 1–2 GHz.

It is among others an advantage of invention that a fully integrated device or a microwave monolithic integrated circuit can be obtained which is much more compact than hitherto known devices. It is also advantageous that a number of identical devices can be fabricated in a single processing chain with the use of standard integrated circuit technology. Furthermore the sizes and dimensions can be determined in a precise manner and the performance is considerably improved. Moreover no labor consuming processes of assembly are needed.

What is claimed is:

1. Tunable microwave monolithic integrated circuit comprising a dielectric material with a variable dielectric constant and a superconducting arrangement so arranged in relation to the dielectric material that at least one interface is formed between the superconducting arrangement and the dielectric material, wherein the dielectric material is low-loss, non-linear bulk material and tuning means are provided for phase velocity tuning of microwaves by controlling propagation of surface plasma waves of the microwaves along the interface(s).

2. Tunable microwave monolithic circuit according to claim 1, wherein the superconducting arrangement comprises a high temperature superconducting material having a negative dielectric constant.

3. Tunable microwave circuit according to claim 1 further comprising a waveguide arrangement for microwaves at least in a frequency range of approximately 1–2 GHz.

4. Tunable microwave monolithic integrated circuit according to claim 3, wherein tuning is achieved via changing the dielectric constant of the dielectric material via temperature controlling and/or electrical means.

5. Tunable microwave monolithic integrated circuit according to claim 1, wherein tuning is achieved via changing a negative dielectric constant of the high temperature superconducting arrangement, via optical and/or temperature controlling means.

6. Tunable microwave monolithic integrated circuit according to claim 1, further comprising a dielectric ridge waveguide.

7. Tunable microwave monolithic integrated circuit according to claim 6, wherein the superconducting arrangement comprises a second film arranged on that side of the dielectric material on which the dielectric ridge waveguide is provided in addition to a first superconducting film.

8. Tunable microwave monolithic integrated circuit according to claim 7, further comprising a parallel plate waveguide.

9. Tunable microwave monolithic integrated circuit according to claim 8, wherein dimensions of the parallel plate waveguide are such as to only support propagation of two surface plasma waves along the interfaces.

10. Tunable microwave monolithic integrated circuit according to claim 1, wherein the superconducting arrangement includes a superconducting film arranged on one side of a slab of the dielectric material, opposite to the side on which a ridge of the dielectric material is formed and the tunable microwave monolithic integrated circuit further comprises an image ridge waveguide.

11. Tunable microwave monolithic integrated circuit according to claim 10, wherein the superconducting film is a high temperature superconducting film and the waveguide acts as a channel for electromagnetic waves having a frequency of approximately 1–2 GHz.

12. Tunable microwave monolithic integrated circuit according to claim 10, wherein the dimensions of the waveguide are such that only a fundamental transverse magnetic mode ($TM_o$) of the electromagnetic wave is supported.

13. Tunable microwave monolithic integrated circuit according to claim 12, wherein all transverse electric modes (TE) are prevented from propagation.

14. Tunable microwave monolithic integrated circuit according to claim 1, further comprising a parallel plate resonator with input and output couplings.

15. Tunable microwave monolithic integrated circuit according to claim 14, wherein the input and output couplings each comprise an image ridge waveguide.

16. Tunable microwave monolithic integrated circuit according to claim 14, wherein the input and output couplings each comprises a parallel plate waveguide.

17. Tunable microwave monolithic integrated circuit according to claim 14, wherein the input/output coupling is controlled by at least one of applying a voltage to, using optical controlling means on, and using temperature controlling means on, the input/output waveguides.

18. Tunable microwave monolithic integrated circuit according to claim 14, wherein the parallel plate resonator is a dual mode resonator and means are arranged to provide coupling between degenerate modes of microwaves.

19. Tunable microwave monolithic integrated circuit according to claim 18, wherein the coupling means comprises a protruding portion of a superconducting film arranged on one side of a dielectric of the resonator.

20. Tunable microwave monolithic integrated circuit according to claim 18, wherein the coupling means comprises a recess in a superconducting film of the parallel plate resonator arranged on one side of the dielectric material of a parallel plate resonator.

21. Tunable microwave monolithic integrated circuit according to claim 16, wherein gaps are provided between the parallel plate waveguides and the parallel plate resonator to control the coupling between each parallel plate waveguide and the resonator respectively.

22. Tunable microwave monolithic integrated circuit according to claim 1, wherein at least one non-superconducting metal film is arranged on at least one superconducting film.

23. Tunable microwave monolithic integrated circuit according to claim 1, wherein an optical arrangement is provided for irradiating at least one dielectric-superconducting film interface, the irradiation being of variable intensity.

24. Tunable microwave monolithic integrated circuit according to claim 1, wherein the tuning is temperature controlled and means are provided for changing at least the temperature at at least one interface between the dielectric material and at least one superconducting film.

25. Tunable microwave monolithic integrated circuit according to claim 1, wherein the arrangement is electrically tunable.

26. Tunable microwave integrated circuit according to claim 25, wherein an external voltage source is provided to supply a DC bias voltage to at least one superconducting film to change the dielectric constant of the dielectric material.

27. Method for tuning the phase velocity of microwaves, in the frequency range of approximately 1–2 GHz in a microwave monolithic integrated circuit, comprising the step of controlling the propagation of surface plasma waves along interfaces(s) between a non-linear bulk dielectric material on which at least one superconducting film is arranged.

28. Method according to claim 27, wherein the controlling step is carried out by optically irradiating the interfaces with a varying intensity of optical radiation.

29. Method according to claim 27, wherein the controlling step comprises varying the temperature at least at the interface between the dielectric material and the at least one superconducting film.

30. Method for tuning the phase velocity of microwaves in the frequency range of approximately 1–2 GHz in a microwave monolithic integrated circuit comprising one of a parallel plate resonator and a multimode filter wherein at least one superconducting film having a negative dielectric constant, is arranged on a non-linear bulk dielectric material with a high dielectric constant comprising the steps of preventing all transverse electric modes from propagating and tuning the microwave integrated circuit at least by applying a variable DC biasing voltage to the superconducting films, thereby controlling propagation of surface plasma waves along an interface between the at least one superconducting film and the bulk dielectric material.

* * * * *